US006925921B2

(12) United States Patent
Lee

(10) Patent No.: US 6,925,921 B2
(45) Date of Patent: Aug. 9, 2005

(54) PUNCH STRUCTURE

(76) Inventor: Ying-Chou Lee, No.9, Alley 9, Lane 42, Lung Feng Street, Fengyuan (TW)

( * ) Notice: Subject to any disclaimer, the term of this patent is extended or adjusted under 35 U.S.C. 154(b) by 19 days.

(21) Appl. No.: 10/751,502

(22) Filed: Jan. 6, 2004

(65) Prior Publication Data

US 2005/0145085 A1 Jul. 7, 2005

(51) Int. Cl.[7] ..... B26F 1/02; B26D 5/16

(52) U.S. Cl. ..... 83/618; 83/167; 83/588; 83/633; 83/698.91; 83/687; 83/691

(58) Field of Search ..... 83/954, 568, 585, 83/589, 605, 633, 684, 685–688, 690, 691, 83/167, 618, 698.91, 588, 620, 628; 30/358, 30/363

(56) References Cited

U.S. PATENT DOCUMENTS 2,405,150 A * 8/1946 Kern ..... 83/618
2,474,344 A * 6/1949 Carpenter ..... 83/167
3,073,199 A * 1/1963 Yerkes ..... 83/549
4,449,436 A * 5/1984 Semerjian et al. ..... 83/571
5,778,750 A * 7/1998 Drzewiecki et al. ..... 83/628
5,797,308 A * 8/1998 Evans et al. ..... 83/618
5,829,334 A * 11/1998 Evans et al. ..... 83/618
6,032,566 A * 3/2000 Evans et al. ..... 83/618
6,109,155 A * 8/2000 Huang ..... 83/628

* cited by examiner

*Primary Examiner*—Boyer D. Ashley
(74) *Attorney, Agent, or Firm*—Bacon & Thomas

(57) ABSTRACT

A punch includes a base with a base plate mounted thereto and a plurality of punch units are fixedly connected to the base plate by bolts. Each punch unit has a bottom plate and a casing which is connected to the bottom plate so as to define a receiving slot between the bottom plate and the casing. A punch member movably extends through the casing and a spring is mounted to the punch member such that a lower end of the punch member may extend through the casing, the receiving slot, the bottom plate and the base plate. Two positioning blocks extend from the bottom plate and are engaged with a connection hole defined in the base plate so as to prevent the punch unit from sliding or rotating relative to the base plate. A handle is pivotably connected to the base plate and has a plurality protrusions on an underside thereof such that the punch members are pushed by the protrusions.

6 Claims, 9 Drawing Sheets

PUNCH STRUCTURE

FIELD OF THE INVENTION

The present invention relates to a punch wherein the punch units are firmly connected to the base plate which has a ridge for guiding document into the slots of the punch units.

BACKGROUND OF THE INVENTION

A conventional punch for punching holes through document is disclosed in FIGS. 6 and 7, and generally includes a base 80 with a base plate 70 mounted thereon so as to define a space for receiving paper debris. A frame 65 is fixedly to connection holes 71 defined in the base plate 70. The frame 65 has slots 651 defined in an upright portion thereof and punch units 60 are fixed to the upright portion of the frame 65 by extending bolts 64 through the slots 651 and connected to respective casings 63 of the punch units 60. Each casing 63 has a punch member 61 connected thereto and a spring is received in the casing 63 and mounted to the punch member 61. Each casing 63 further has a hole defined in an underside thereof so that the punch member 61 may extend through the hole and insert into a through slot 72 defined in the base plate 70. A handle 50 is pivotably connected to two lugs 73 on the base plate 70 and includes several protrusions 51 which project from an underside of the handle 50 so that when the user pivots the handle 50 downward, the protrusions 51 push the punch members 61 downward to penetrate the document 90 inserted in the receiving slot 631 of each of the punch units 60. It is noted that the base plate 70 tends to be bent by the huge downward force coming from the punch members 61. Besides, it takes a lot of time to assemble the punch units 60 to the frame 65.

Referring to FIG. 8, an improved structure of the punch is developed and the punch units 60 are connected to the base plate 70 directly by bolts 64 from an underside of the base plate 70. Each punch unit 60 has an engaging edge 632 which extends downward and is engaged with a recess 74 defined in a front side of the base plate 70. Nevertheless, the engagement of the engaging edge 632 and the recess 74 cannot provide a desired feature so that the punch units 60 could rotate about the bolt 64. In addition, when inserting document into the receiving slot 631 of the punch unit 60, the sheets of the document could be tangled by the gap between the engaging edge 632 and the surface of the recess 74.

The present invention intends to provide a punch that the punch units each have positioning blocks for securely connect the punch units on the base plate. The base plate has a ridge extending from a top surface of the base plate so as to guide the document into the receiving slot of each punch unit.

SUMMARY OF THE INVENTION

The present invention relates to a punch which comprises a base, a base plate mounted to the base, a plurality of punch units fixedly connected to the base plate and a handle having a plurality of protrusions on an underside thereof and pivotably connected to two lugs on the base plate. The base plate has a plurality of through holes and connection holes. Each punch unit has a bottom plate and a casing which is connected to the bottom plate so as to define a receiving slot there between. The bottom plate has a first hole defined therethrough and the casing has a second hole that is located in alignment with the first hole. A punch member movably extends through the casing and a spring is mounted to the punch member and biased between two opposite walls of the casing. The punch member is located such that a lower end of the punch member may extend through the second hole, the receiving slot, the first hole and the through hole by pivoting the handle downward. A bolt extends through one of the connection holes and is connected to the bottom plate of one of the punch units. Two positioning blocks extend from the bottom plate and are engaged with the connection hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
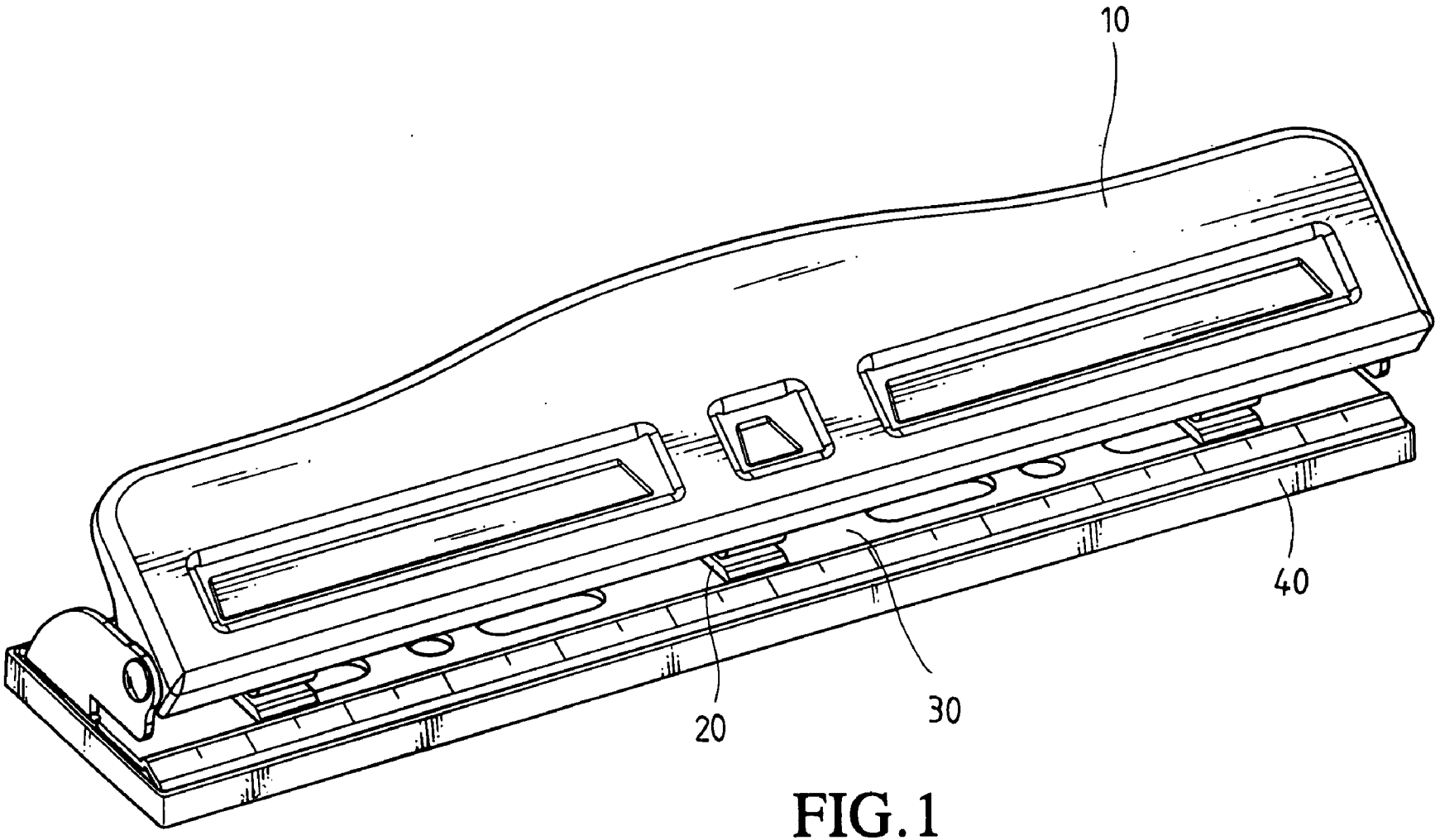
FIG. 1 is a perspective view of the punch of the present invention.
Figure 2:
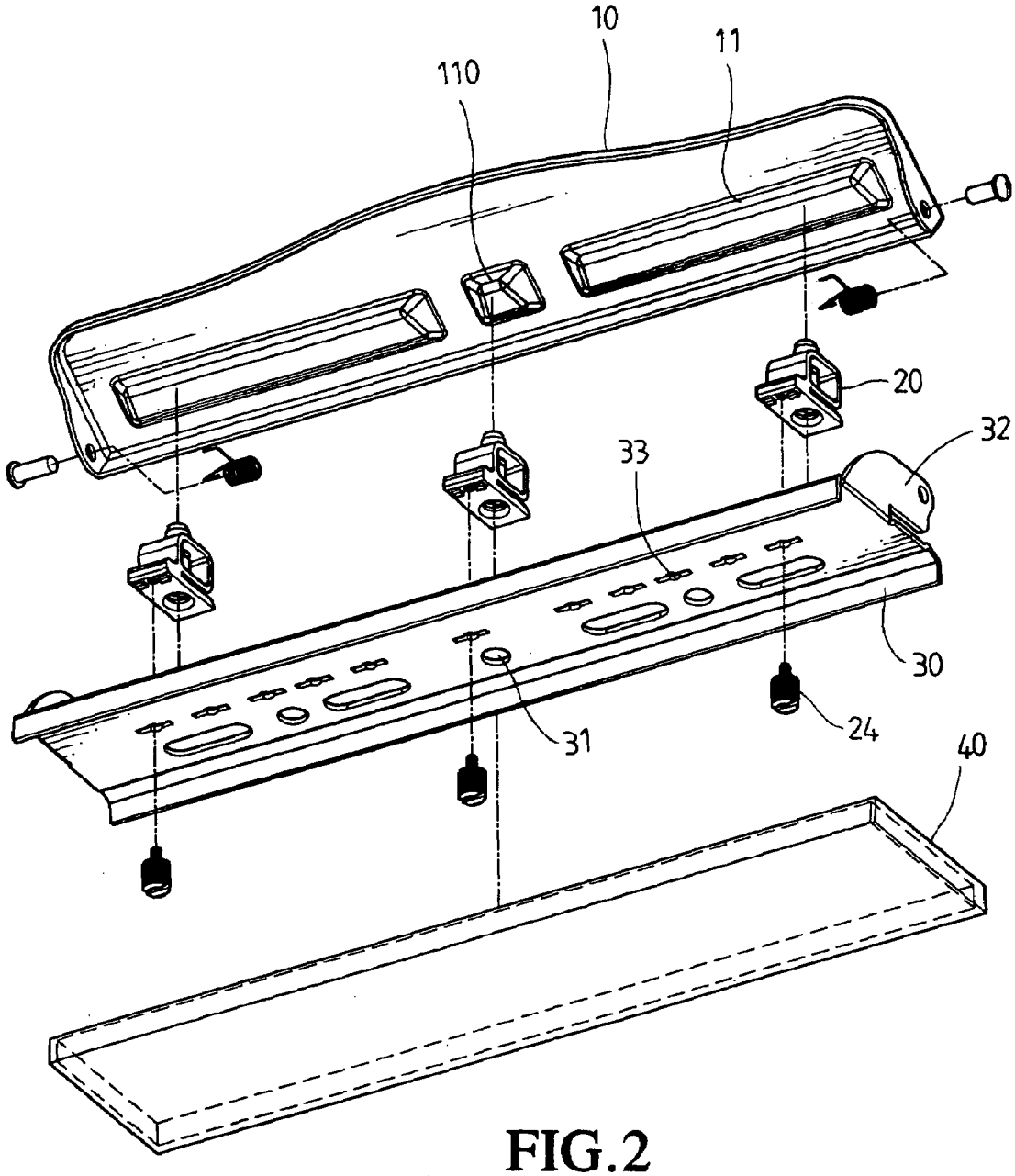
FIG. 2 is an exploded view to show the punch of the present invention.
Figure 3:
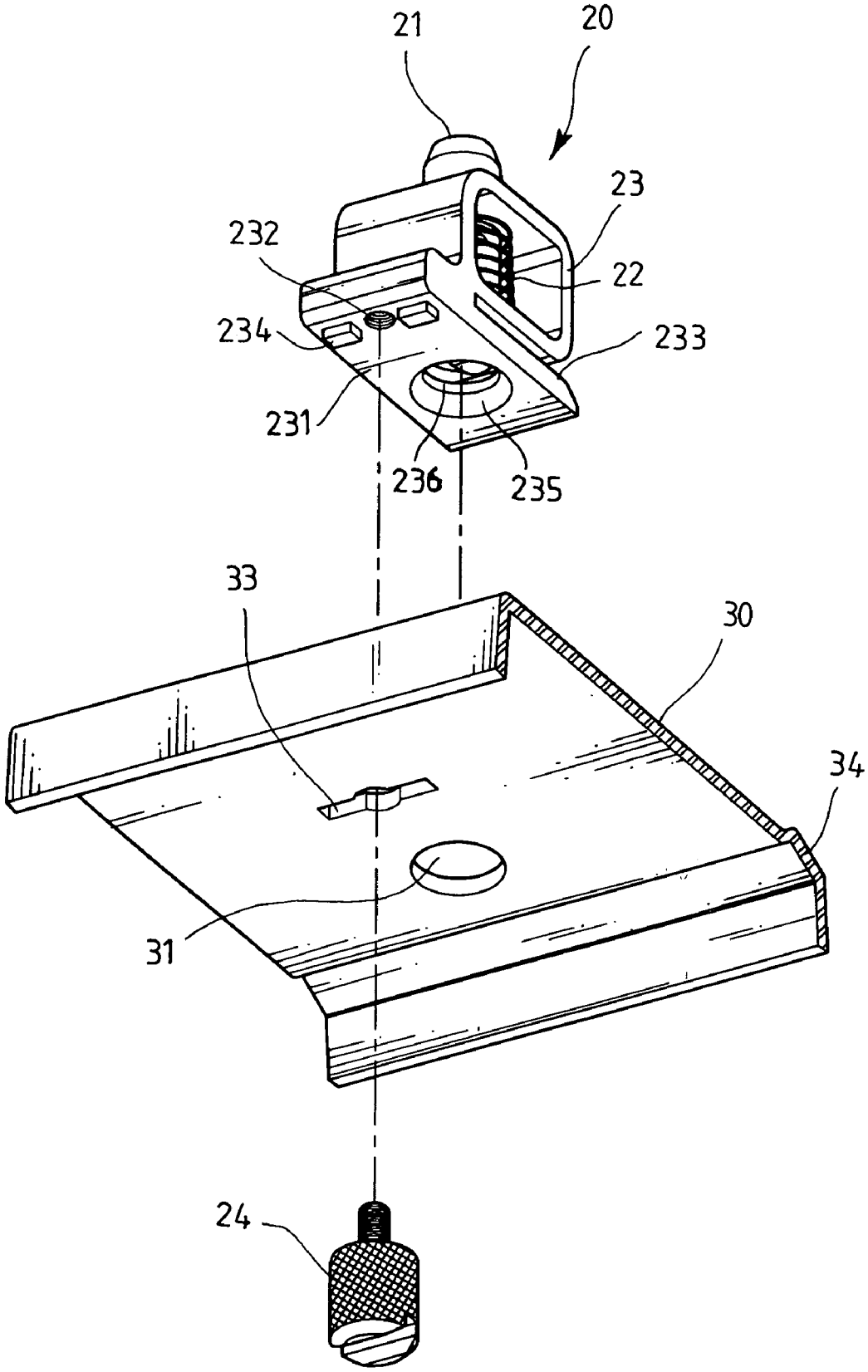
FIG. 3 is an exploded view of the punch unit and the base plate of the punch of the present invention.
Figure 4:
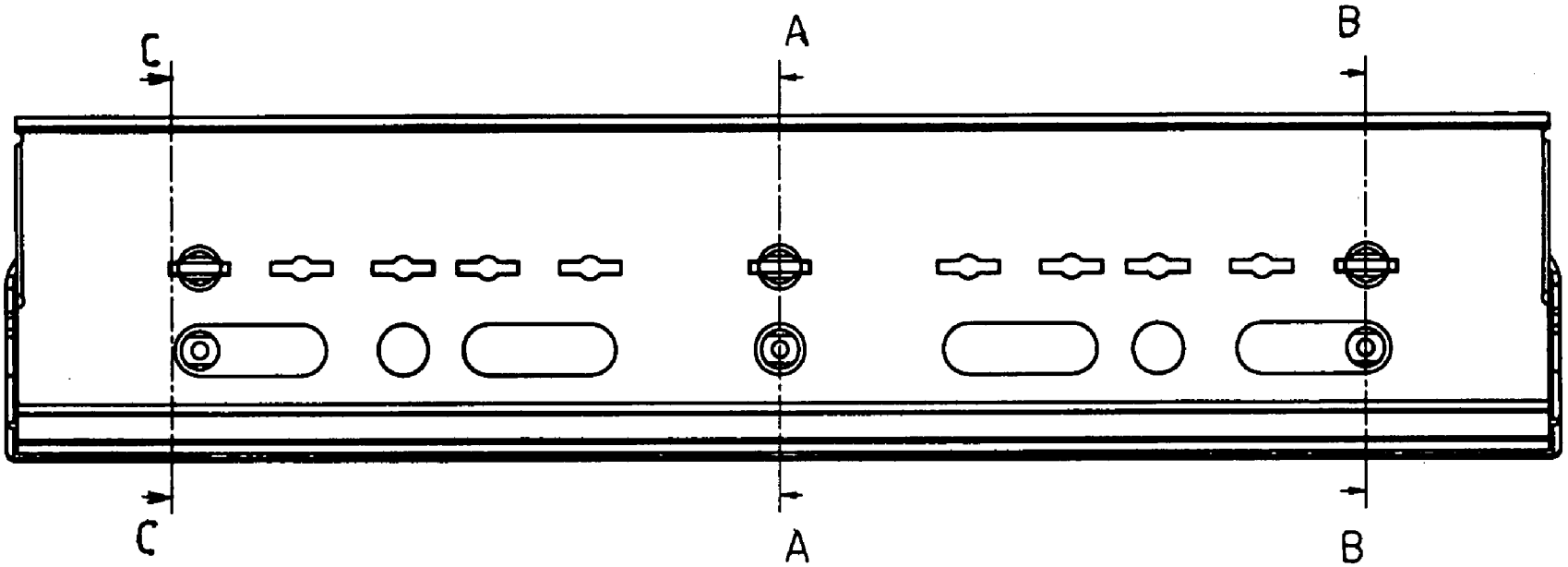
FIG. 4 shows a bottom view of the base plate of the punch of the present invention.

Referring to FIGS. 1 to 3, the punch of the present invention comprises a base 40 having walls on a periphery thereof and a base plate 30 is mounted to the walls of the base 40 so as to define a space for receiving paper debris. The base plate 30 has a plurality of through holes 31 and connection holes 33.

A plurality of punch units 20 each have a bottom plate 231 and a casing 23 which is connected to the bottom plate 231 so as to define a receiving slot 233 between the bottom plate 231 and the casing 23. The bottom plate 231 includes a first hole 235 defined therethrough and the casing 23 includes a second hole 236 that is located in alignment with the first hole 235. A punch member 21 movably extends through the casing 23 and a spring 22 is mounted to the punch member 21 and biased between two opposite walls of the casing 23. The punch member 21 is located such that a lower end which is the cutting end of the punch member 21 may extend through the second hole 236, the receiving slot 233, the first hole 235 and the through hole 31. A bolt 24 extends through one of the connection holes 33 and is connected to a threaded hole 232 in the bottom plate 231 of one of the punch units 20. Two positioning blocks 234 extend from the bottom plate 231 and are located such that the threaded hole 232 is located between the two positioning blocks 234. The connection holes 33 each include two elongate portions with which the positioning blocks 234 are engaged.

A handle 10 is pivotably connected to two lugs 32 on two ends of the base plate 30 and has a plurality of protrusions on an underside thereof such that top ends of the punch members 21 are pushed by the protrusions.

Figure 5A:
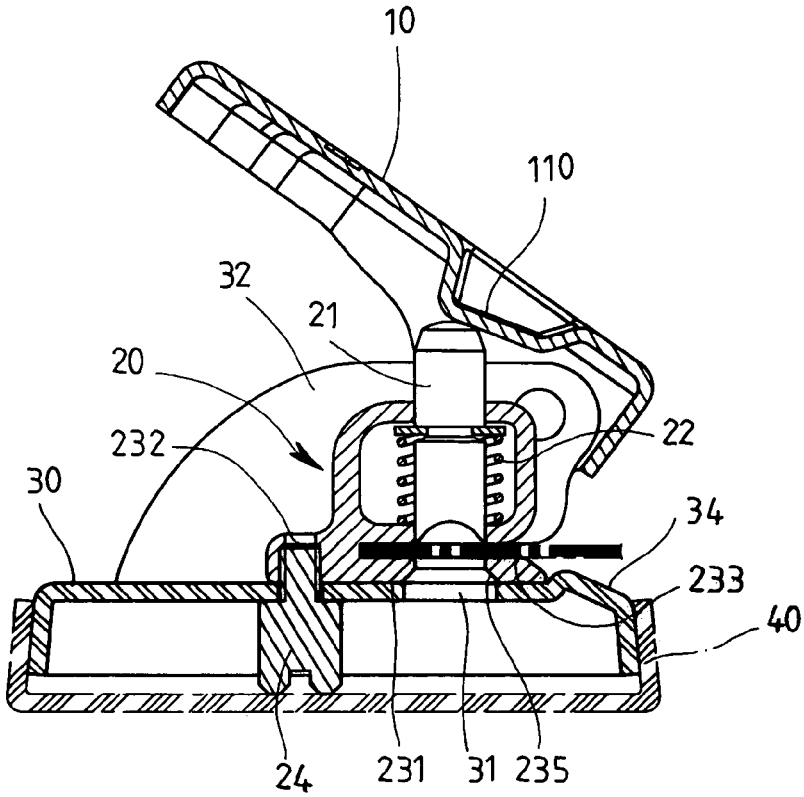
FIG. 5A shows a side cross sectional view taken from line A—A in FIG. 4 of the punch of the present invention.
Figure 5B:
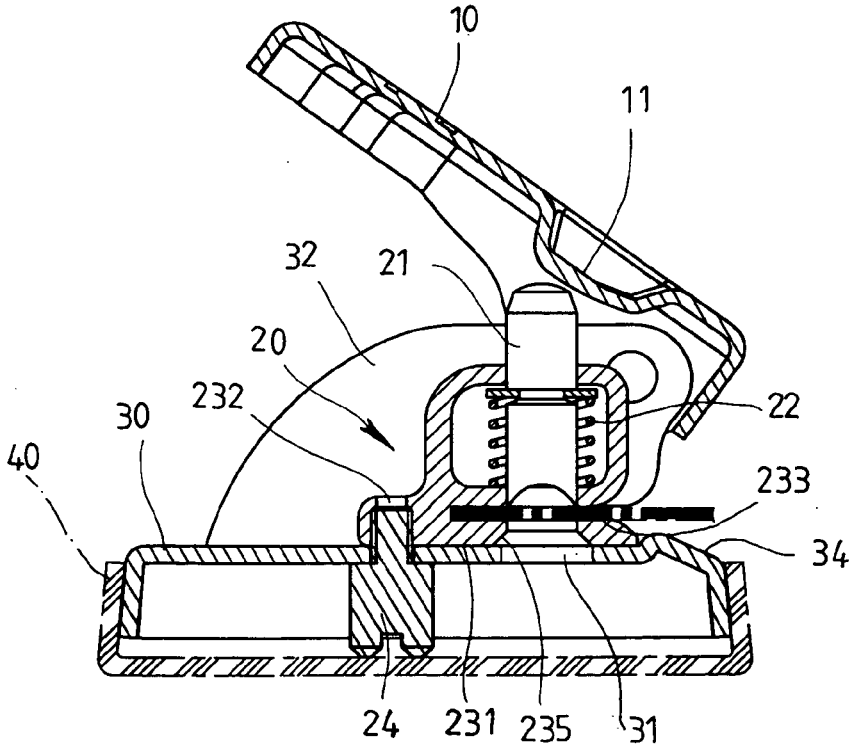
FIG. 5B shows a side cross sectional view taken from line B—B in FIG. 4 of the punch of the present invention.
Figure 5C:
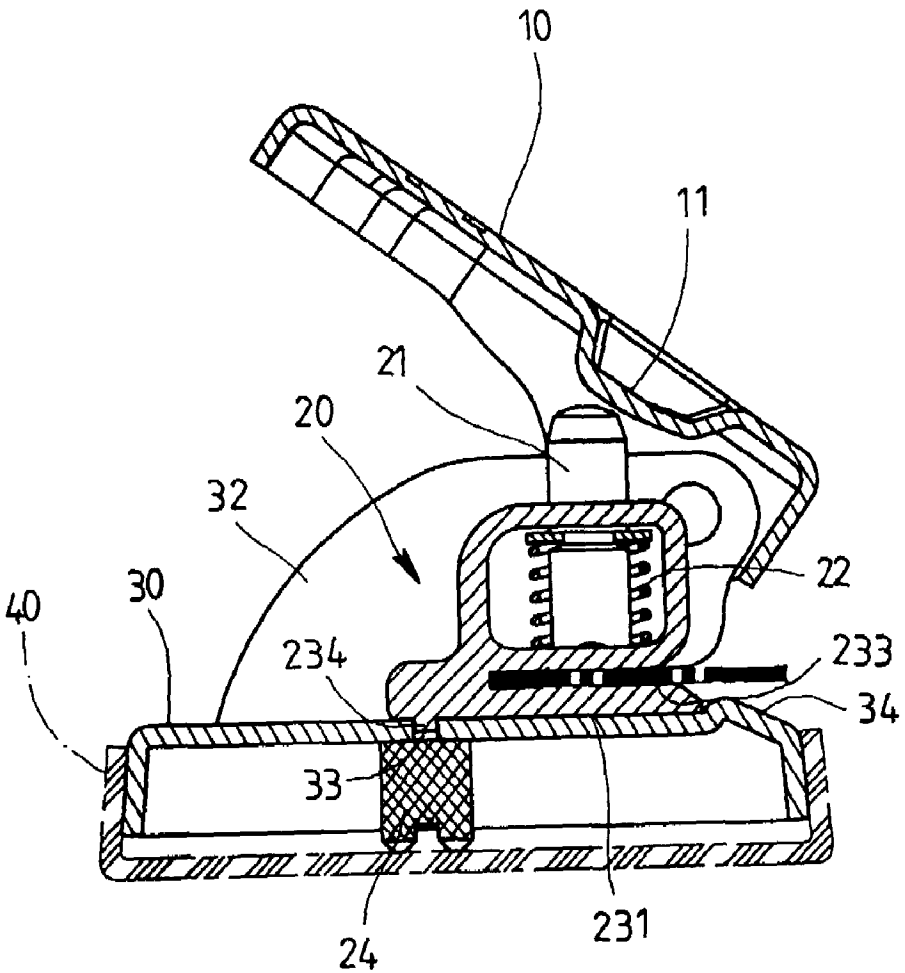
FIG. 5C shows a side cross sectional view taken from line C—C in FIG. 4 of the punch of the present invention.
Figure 6:
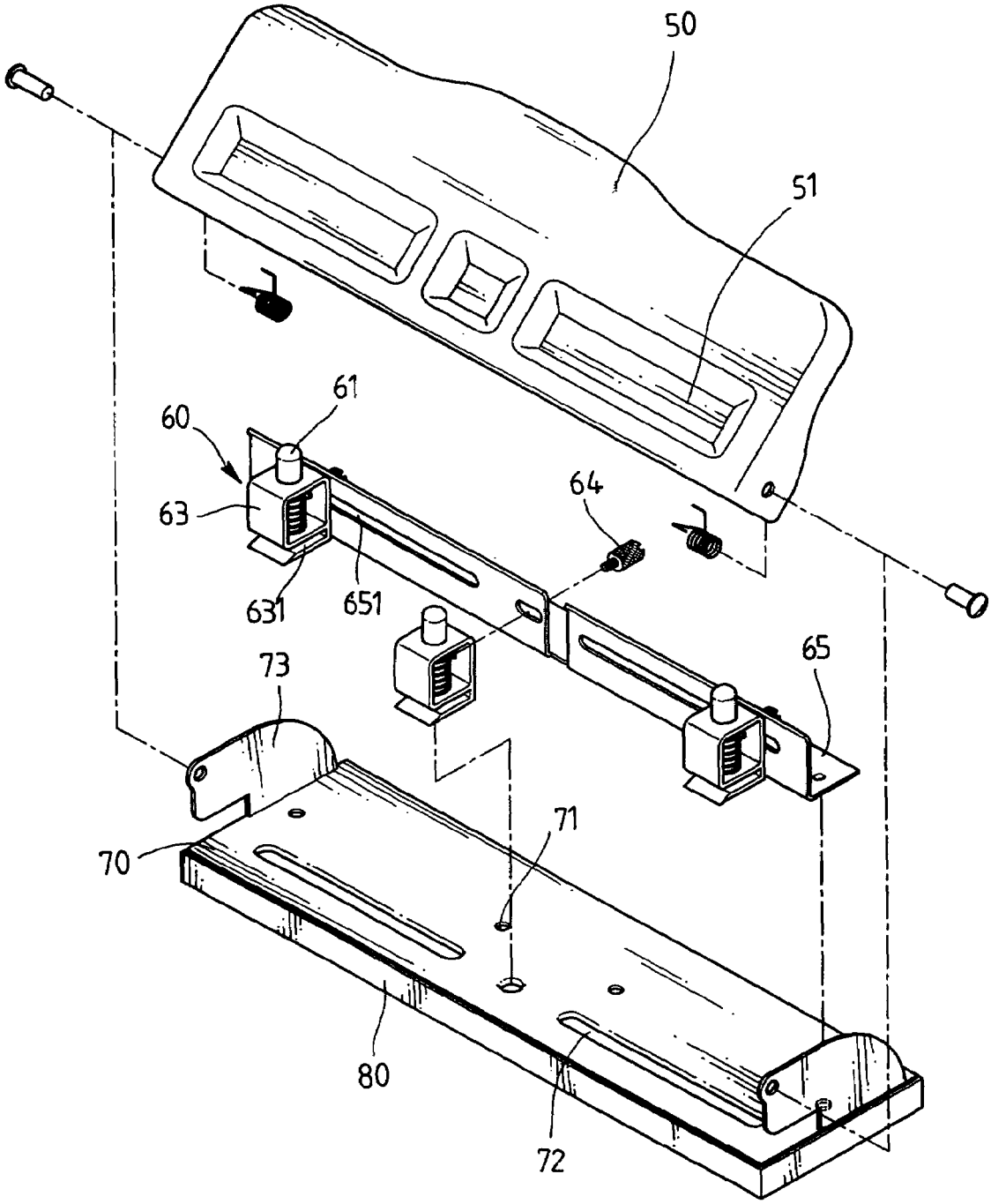
FIG.6 PRIOR ART
FIG. 6 is an exploded view to show a conventional punch.
Figure 7:
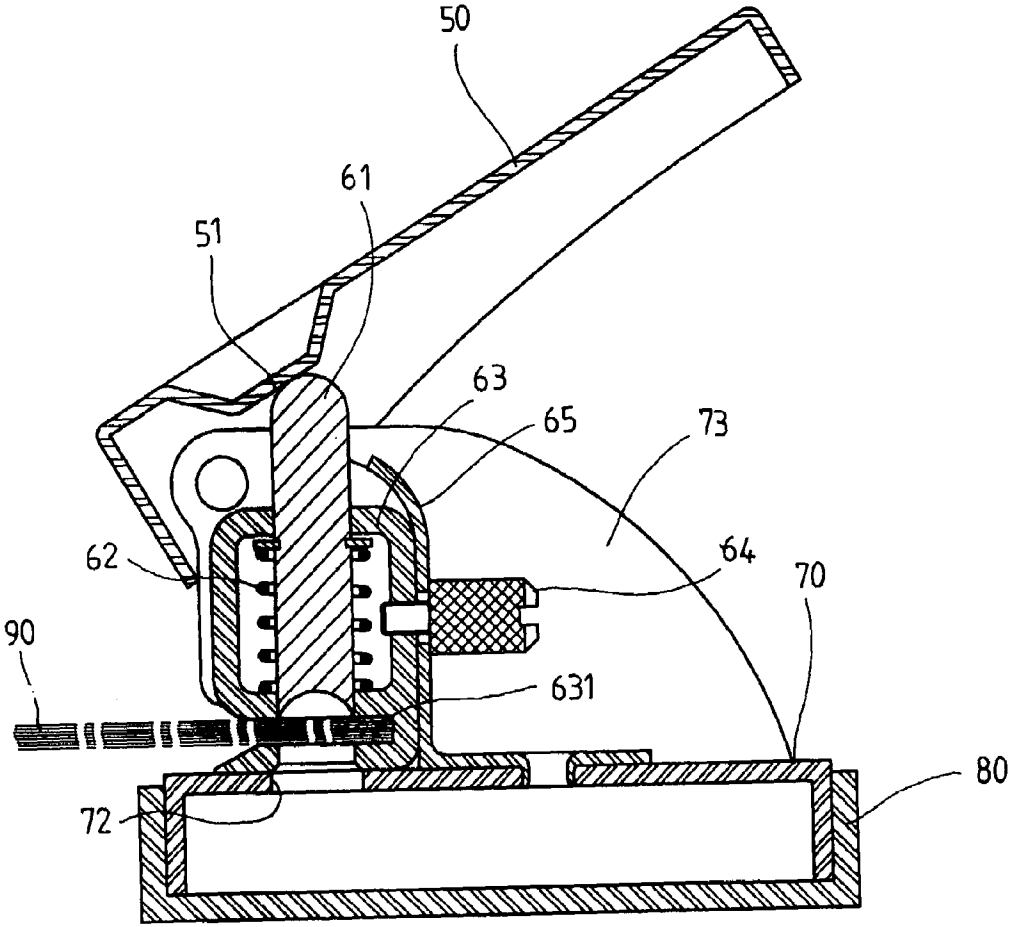
FIG.7 PRIOR ART
FIG. 7 is a cross sectional view of the conventional punch as shown in FIG. 6.
Figure 8:
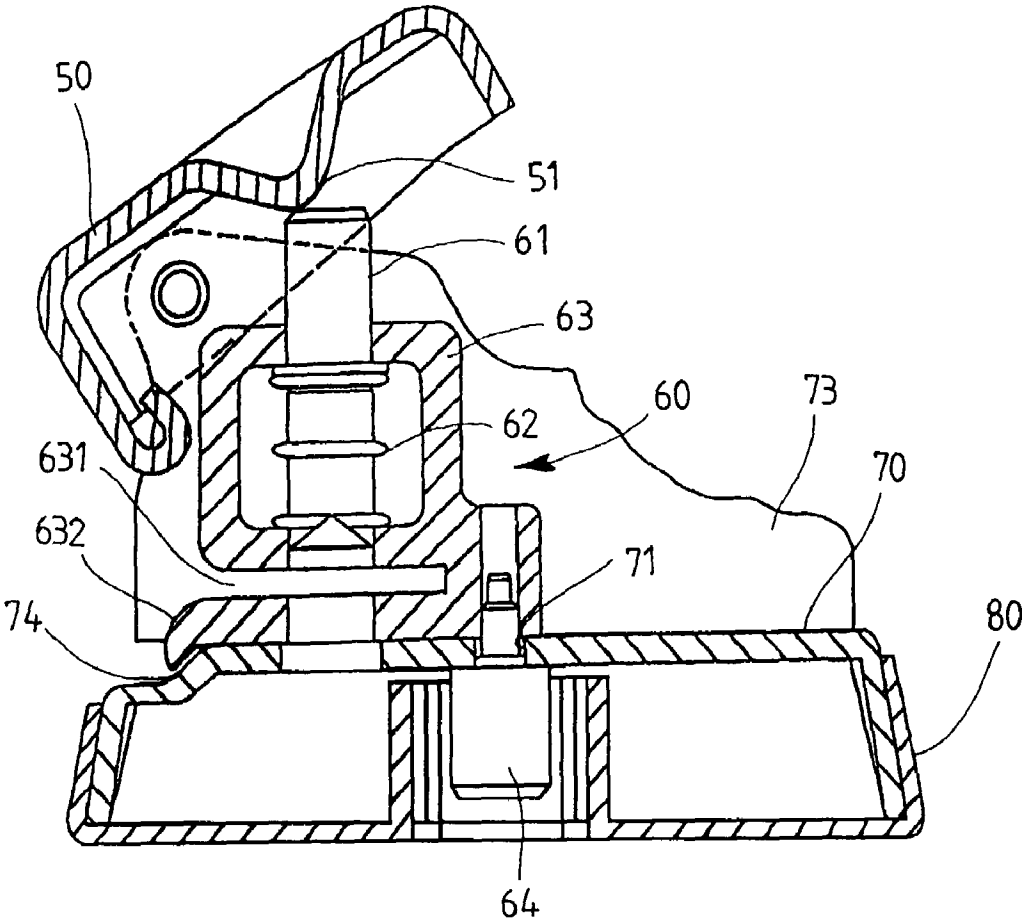
FIG. 8 PRIOR ART
FIG. 8 is a cross sectional view of another conventional punch.

Referring to FIGS. 4, 5A, 5B and 5C, the protrusions are composed of a central protrusion 110 and two side protrusions 11. The central protrusion 110 has a thickness larger than a thickness of each of the two side protrusions 11 so that the central protrusion 110 touches the punch unit 20 corresponding thereto before the two side protrusions 11 touch the punch units 20 corresponding thereto as seen in FIG. 5A. Therefore, when punching a pile of document in the receiving slot 233, the central protrusion 110 first pushes the punch member 21 of the punch unit 20 at the central position of the base plate 30, and then the other two protrusions 11 push the punch members 21 corresponding thereto. By this way, the pressure of the punch member 21 at the central position first penetrates the document and receives less resistance and the user may save a lot of force when using the punch.

As shown in FIG. 3, 5A, 5B, or 5C, the base plate 30 includes a ridge 34 extending upward from a front side thereof and a front side of the bottom plate 231 of each punch unit 20 has an inclined top surface. The front side of the bottom plate 231 is located at a rear end of the ridge 34 and a highest portion of the ridge 34 is higher than a lower edge of the inclined top surface of the front side of each of the bottom plates 231. By this particular arrangement, when inserting document in the receiving slot 233, the ridge 34 guides the document into the receiving slot 233 and the document will not be inserted into the gap between the ridge 34 and the lower edge of the front side of the bottom plate 231.

While we have shown and described the embodiment in accordance with the present invention, it should be clear to those skilled in the art that further embodiments may be made without departing from the scope of the present invention.

What is claimed is:

1. A punch comprising:

a base having walls on a periphery thereof;

a base plate mounted to the walls of the base and having a plurality of through holes and connection holes;

a plurality of punch units each having a bottom plate and a casing which is connected to the bottom plate, a receiving slot defined between the bottom plate and the casing, the bottom plate including a first hole defined therethrough and the casing including a second hole that is located in alignment with the first hole, a punch member movably extending through the casing and a spring mounted to the punch member and biased between two opposite walls of the casing, the punch member being located such that a lower end of the punch member may extend through the second hole, the receiving slot, the first hole and the through hole, a bolt extending through one of the connection holes and connected to the bottom plate of one of the punch units, two positioning blocks extending from the bottom plate and being engaged with the connection hole, wherein the connection holes each include two elongate portions with which the positioning blocks are engaged, and a handle pivotably connected to two lugs on two ends of the base plate and having a plurality of protrusions on an underside thereof such that top ends of the punch members are pushed by the protrusions.

2. The punch as claimed in claim 1, wherein the protrusions are composed of a central protrusion and two side protrusions, the central protrusion has a thickness larger than a thickness of each of the two side protrusions so that the central protrusion touches the punch unit corresponding thereto before the two side protrusions touch the punch units corresponding thereto.

3. The punch as claimed in claim 1, wherein the base plate includes a ridge extending upward from a front side thereof and a front side of the bottom plate of each punch unit has an inclined top surface, the front side of the bottom plate is located at a rear end of the ridge and a highest portion of the ridge is higher than a lower edge of the inclined top surface of the front side of each of the bottom plates.

4. A punch comprising:

a base having walls on a periphery thereof;

a base plate mounted to the walls of the base and having a plurality of through holes and connection holes, a ridge extending upward from a front side of the base plate;

a plurality of punch units each having a bottom plate and a casing which is connected to the bottom plate, a receiving slot defined between the bottom plate and the casing, the bottom plate including a first hole defined therethrough and the casing including a second hole that is located in alignment with the first hole, a punch member movably extending through the casing and a spring mounted to the punch member and biased between two opposite walls of the casing, the punch member being located such that a lower end of the punch member may extend through the second hole, the receiving slot, the first hole and the through hole, a bolt extending through one of the connection holes and connected to the bottom plate of one of the punch units, and a handle pivotably connected to two lugs on two ends of the base plate and having a plurality of protrusions on an underside thereof such that top ends of the punch members are pushed by the protrusions, wherein the protrusions are composed of a central protrusion and two side protrusions, the central protrusion has a thickness larger than a thickness of each of the two side protrusions so that the central protrusion touches the punch unit corresponding thereto before the two side protrusions touch the punch units corresponding thereto.

5. The punch as claimed in claim 4, wherein two positioning blocks extend from the bottom plate and the connection holes each include two elongate portions with which the positioning blocks are engaged.

6. The punch as claimed in claim 4, wherein a front side of the bottom plate of each punch unit has an inclined top surface and is located at a rear end of the ridge, a highest portion of the ridge is higher than a lower edge of the inclined top surface of the front side of each of the bottom plates.

* * * * *